US011535904B2

(12) United States Patent
Olivieri et al.

(10) Patent No.: US 11,535,904 B2
(45) Date of Patent: Dec. 27, 2022

(54) COOLING BOX FOR A SHAFT FURNACE

(71) Applicants: PAUL WURTH S.A., Luxembourg (LU); PAUL WURTH ITALIA S.P.A., Genoa (IT)

(72) Inventors: Stefano Olivieri, Genoa (IT); Lorenzo Micheletti, Castagneto Carducci (IT); Fabio Cravino, Arenzano (IT)

(73) Assignees: PAUL WURTH S.A., Luxembourg (LU); PAUL WURTH ITALIA S.P.A., Genoa (IT)

( * ) Notice: Subject to any disclaimer, the term of this patent is extended or adjusted under 35 U.S.C. 154(b) by 0 days.

(21) Appl. No.: 17/263,730

(22) PCT Filed: Jul. 26, 2019

(86) PCT No.: PCT/EP2019/070282
§ 371 (c)(1),
(2) Date: Jan. 27, 2021

(87) PCT Pub. No.: WO2020/025508
PCT Pub. Date: Feb. 6, 2020

(65) Prior Publication Data

US 2021/0371943 A1 Dec. 2, 2021

(30) Foreign Application Priority Data

Aug. 1, 2018 (EP) ..... 18186883

(51) Int. Cl.
*C21B 7/10* (2006.01)
*F27D 1/12* (2006.01)
*F27D 9/00* (2006.01)

(52) U.S. Cl.
CPC ..... *C21B 7/106* (2013.01); *F27D 1/12* (2013.01); *F27D 2009/0021* (2013.01); *F27D 2009/0043* (2013.01)

(58) Field of Classification Search
CPC ... C21B 7/106; F27B 1/24; F27D 1/12; F27D 2009/0021; F27D 2009/0043
(Continued)

(56) References Cited

U.S. PATENT DOCUMENTS 1,434,849 A * 11/1922 Smith ..... C21B 7/10 122/6 R
1,749,395 A 3/1930 Rice
(Continued)

FOREIGN PATENT DOCUMENTS

CN 203403117 U 1/2014
DE 2925127 A1 1/1981
(Continued)

OTHER PUBLICATIONS

CN Office Action dated Feb. 23, 2022 re: Application No. 201980050951.0, pp. 1-3, citing: DE 2925127A1.
(Continued)

*Primary Examiner* — Jessee R Roe
*Assistant Examiner* — Michael Aboagye
(74) *Attorney, Agent, or Firm* — Cantor Colburn LLP

(57) ABSTRACT

A cooling box for a metallurgical furnace including an elongated hollow body extending from a front end, to an opposite rear end, the rear end being, in use, connected to a wall of the furnace; the body includes an inner chamber having a cooling circuit configured to receive a flow of coolant fluid therein between at least one inlet and at least one outlet; the cooling box further including at least one partition plate fitted in the inner chamber through a form-fit connection to form the cooling circuit.

9 Claims, 4 Drawing Sheets

(58) Field of Classification Search
USPC ..... 266/190, 193, 194, 241
See application file for complete search history.

(56) References Cited

U.S. PATENT DOCUMENTS

| | | | | | |
|---|---|---|---|---|---|
| 1,830,318 | A | * | 11/1931 | Harlan | C21B 7/10 122/6 R |
| 3,241,528 | A | * | 3/1966 | Loecher | F28D 7/12 266/193 |
| 3,679,194 | A | * | 7/1972 | Jones | C21B 7/10 373/76 |
| 4,029,053 | A | | 6/1977 | Higuchi | |
| 4,245,982 | A | | 1/1981 | Radoux et al. | |
| 4,487,400 | A | * | 12/1984 | Gheen | F27D 1/12 122/6 A |
| 4,619,442 | A | * | 10/1986 | Hattori | C21B 7/10 266/193 |
| 10,247,477 | B2 | * | 4/2019 | Smith | F27D 1/12 |

FOREIGN PATENT DOCUMENTS

| | | | |
|---|---|---|---|
| KR | 20040049018 | A | 6/2004 |
| SU | 43906 | A1 | 8/1935 |

OTHER PUBLICATIONS

International Search Report dated Aug. 22, 2019 re: Application No. PCT/EP2019/070282,, pp. 1-3, citing: US 1 749 395 A and KR 2004 0049018 A.

Written Opinion dated Aug. 22, 2019 re: Application No. PCT/EP2019/070282,, pp. 1-5, citing: US 1 749 395 A and KR 2004 0049018 A.

CN Office Action dated Jul. 19, 2022 re: Application No. 201980050951.0, pp. 1-19.

IN Office Action dated Aug. 8, 2022 re: Application No. 202117003787, pp. 1-6.

* cited by examiner

COOLING BOX FOR A SHAFT FURNACE

TECHNICAL FIELD

The present disclosure relates to a cooler for cooling internal plates of a shaft furnace. The disclosure particularly relates to a cooling box and a method for manufacturing a cooling box for cooling the internal wall of a shaft furnace.

BACKGROUND

It is well known to provide blast furnace walls with coolers in order to dissipate the heat in the furnace wall and thereby increase the service life of the furnace. Coolers are generally mounted in a lining of the furnace wall requiring an important number of adjacent coolers. The type of cooler that interests us here is the so called cooling box.

A cooling box is typically made out of copper, steel or an alloy. It has a shape which is roughly that of a flattened parallelepiped, and it is provided with one or more cooling circuits; i.e. a path through which coolant fluid, like for example water, circulates.

Cooling boxes are usually welded to the blast furnace shell to ensure gas tight sealing and serve not only to cool the furnace wall but also to secure and support the refractory brickwork which further defines the inner lining of the furnace wall.

The side of the cooling box, which connected to the furnace wall, commonly comprises openings or connectors in order to plug external coolant feed and recovery pipes to an inlet and an outlet of the cooling circuit. In practice, water is introduced into the cooling box through the inlet, travels along the cooling path gaining heat from the furnace and leaves the cooling box by the outlet. The internal cooling circuit is generally the main functional element of the design of a cooling box.

As the inner lining of the furnace wall erodes, cooling boxes become exposed to the harsh operating conditions inside the furnace. Erosion and damage of cooling boxes occurs and maintenance operations have to be performed to replace damaged cooling boxes.

Due to the large number of cooling boxes mounted on a furnace wall and their replacement, the manufacturing cost of a cooling box is a critical constraint in the development of a new cooling box.

A typical cooling box is for example disclosed in U.S. Pat. No. 4,029,053. It comprises a hollow body, with a flat elongated shape. The body has a front end configured to face the furnace interior and a rear end with flanges for fixing the cooling box to a furnace wall. Inside the body, the cooling box comprises an internal cooling fluid circuit with partition walls creating circuit loops.

A common manufacturing process of such a cooling box uses a casting technique, particularly with a sand mould. This method allows complicated shapes of cooling circuit to be built inside the cooling box, but its main drawback is that the sand casting step requires a long manufacturing process including preparation of the mould, and eventually further operations for drilling evacuation holes for the sand, and then closing the holes that will have no other further purposes.

Another example of a cooling box is shown in document DE 40 35 894. In this document, the cooling box comprises an internal cooling circuit formed beforehand by plates bent into a predetermined shape. The cooling circuit is then placed between a top wall and a bottom wall. The connection between the cooling circuit and the top and bottom walls is realized using explosion welding technique.

In the latter manufacturing method, the cooling circuit is built in a separate manufacturing step and then integrated in a cooling box body. The shape of the cooling circuit can be realized easily. However, this method also involves a complex and expensive step of explosion welding.

BRIEF SUMMARY

It is therefore desirable to provide an improved cooling box and an improved manufacturing method for such a cooling box, wherein the above described shortcomings are avoided.

The present disclosure proposes a cooling box for a metallurgical furnace comprising an elongated hollow body extending from a front end to an opposite rear end. The rear end is, in use, connected to a wall of the furnace.

The body comprises external walls defining the inner chamber, wherein the external walls comprise a top wall, an opposite, preferably parallel, bottom wall, and peripheral walls connecting the edges of the top and bottom walls of the body. The body further comprises an inner chamber with a cooling circuit configured to receive a flow of coolant fluid therein between at least one inlet and at least one outlet. In blast furnaces, the typical cooling fluid is water, but any suitable fluid may be used in the cooling box.

The cooling box further comprises at least one partition plate fitted in the inner chamber through a form-fit connection to form the cooling circuit.

According to the disclosure, the top and bottom walls respectively comprise at least one slot facing one another to receive the partition plate. The slots can be machined in the inner chamber in order to provide a positioning element for the partition plate. The partition plate preferably extends from the top wall to the bottom wall.

The disclosure comprises a new design of cooling box. The cooling circuit in the cooling box may be obtained by removing material to create an inner chamber and inserting partition plates in the chamber. The cooling circuit is built using form-fit connections between the added partition plates and the body, requiring no welding operation. Accordingly, the cooling box may be obtained entirely through machining from a single block of material. The cooling box design is therefore more efficient with regard to its manufacturing cost and time.

Advantageously, the rear end of the cooling box comprises a rear wall with an opening sealed by a metallic cover plate. The opening in the rear wall may be used to insert the partition plates into the inner chamber of the cooling box. The cover plate may be connected to the rear wall via any suitable means, like for example screws. No mandatory welding operation needs to be performed on the body to ensure the sealing of the inner chamber of the cooling box.

Preferably, the cover plate has at least one inlet port and at least one outlet port, respectively in communication with the inlet and outlet of the inner chamber. The cover plate is fully integrated with the cooling circuit of the body providing an easy connection of the cooling circuit to feed and recovery pipes of an external water supply system.

In order to improve the robustness of the cooling box, the partition plate is advantageously secured inside the inner chamber by the cover plate. The cover applies a pressure load on the partition plate, preferably against the reaction of an abutment or in a slot inside the inner chamber configured to receive the partition plate, thereby avoiding possible movements of the partition plate in the inner chamber.

Advantageously, the partition plate further comprises tongues corresponding to slots of the top and bottom walls in order to engage the partition plate in the top and bottom walls.

The dimensions and shape of the partition plate(s) may provide a great variety of possibilities for defining the cooling circuit. In embodiments, the partition plate comprises an aperture to let coolant fluid through the partition plate.

In preferred embodiments, the partition plate may be a straight plate; or comprise a U-shaped element. Other shapes may be provided according to the desired cooling circuit. As further described below, in order to insert the U-shaped element into the inner chamber through the opening of the rear wall, the top and bottom walls preferably have a stepped surface with a distal face and a proximal face forming an abutment step for the U-shaped element. This configuration may be used to insert other shapes of partition plates as well. The partition plate comprising the U-shaped element is then inserted following the abutment step on the distal face of the top and bottom walls simultaneously.

Advantageous embodiments of the cooling box further comprise a gasket between the rear wall and the cover plate. The gasket improves the sealing connection between the cover plate and the rear wall of the body.

Preferably, the cover plate is fixed to the rear wall with screws, requiring no welding or special skills while being cost and time effective.

In another aspect, the present disclosure concerns a method for manufacturing a cooling box, the method comprising the steps of:

providing an elongated hollow body extending from a front end, to an opposite rear end, said rear end being, in use, connected to a wall of the furnace; said body having external walls comprising a top wall, an opposite bottom wall, and peripheral walls connecting the edges of the top and bottom walls of the body;

forming an inner chamber between said external walls, said inner chamber being configured to receive a flow of coolant fluid therein between at least one inlet and at least one outlet, wherein the rear end of the body comprises an opening accessing the inner chamber;

machining in the top and bottom walls respectively at least one slot facing one another from the opening of the rear end;

inserting a partition plate into the inner chamber through the opening of the rear end of the body thereby forming a cooling circuit.

Accordingly, the manufacturing method of the cooling box of the disclosure does not involve a mandatory step of sand casting.

Advantageously, the method also comprises the step of sealingly closing an opening of a rear end of the body's with a cover plate having at least one inlet and at least one outlet to let a flow of cooling fluid in and out of the inner chamber. The opening serves for inserting the partition plates into the inner chamber and further requires sealing. This step may be performed by any suitable means without implying a welding operation. For example, the opening may be closed by screwing or otherwise attaching the cover plate to the rear end of the body.

BRIEF DESCRIPTION OF THE DRAWINGS

Further details and advantages of the present disclosure will be apparent from the following detailed description of not limiting embodiments with reference to the attached drawing, wherein.

DETAILED DESCRIPTION

Figure 1:
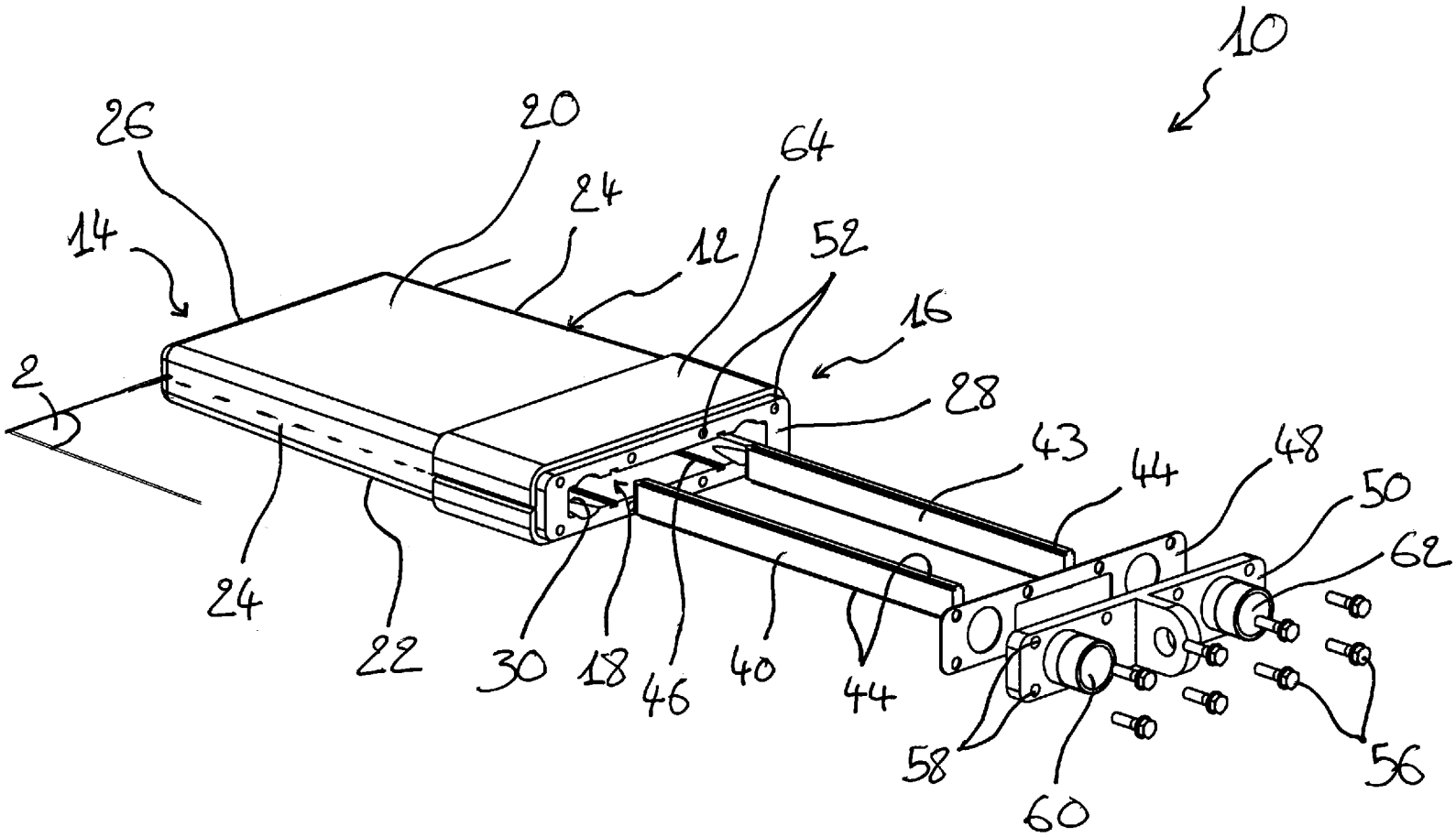
FIG. 1 is an exploded perspective view of one preferred embodiment of the cooling box according to the disclosure.

As shown in FIG. 1, the cooling box 10 according to one preferred embodiment of the disclosure comprises an elongated hollow body 12. The body 12 has a parallelepiped shape extending longitudinally from a front end 14, to an opposite rear end 16. When the cooling box is mounted on a furnace wall, not shown, the front end faces the interior of the furnace, and the opposite rear end is connected to the wall of the furnace.

The body 12 is preferably made of copper, taking advantage of the good thermal conductivity of the metal, but it may also be made of another metal, like for example steel or an alloy of steel and copper.

The hollow body 12 comprises an inner chamber 18 configured to receive a flow of cooling fluid therein. The inner chamber 18 is defined by external walls comprising a rectangular top wall 20, a similar bottom wall 22, opposite and generally parallel to the top wall 20, and peripheral walls joining the edges of the top and bottom walls 20, 22. The peripheral walls here comprise two side walls 24, and one front wall 26, the latter defining the front end 14 of the body 12.

The top and bottom walls 20, 22, and the peripheral walls are all sealingly joined in order to receive a flow of coolant fluid, preferably water, therein. Advantageously, all the external walls of the body 12 are formed in one piece.

The rear end 16 of the cooling box 10 comprises a rear wall 28 with a wide opening 30. As shown in FIG. 1, the opening 30 is entirely open to the inner chamber, and the rear wall 28 is formed by the edges of the top wall, the bottom wall and the two side walls 24.

Figure 2:
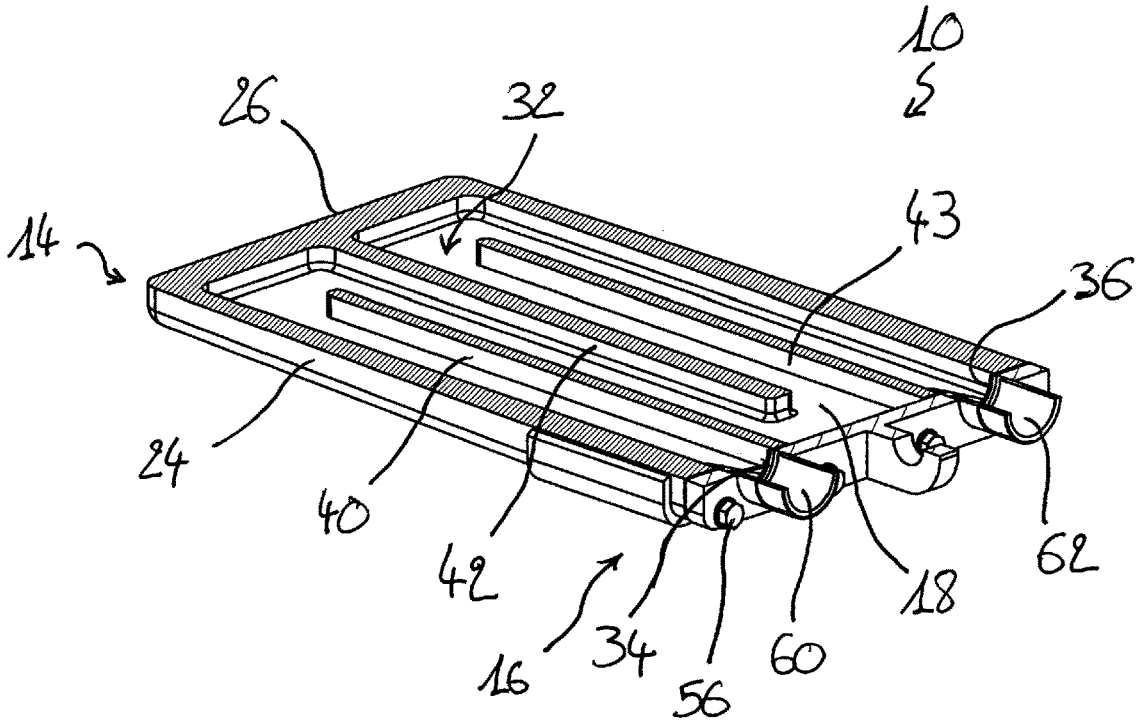
FIG. 2 is a perspective view of the cooling box of FIG. 1 cut through a plane 2 of FIG. 1.

As shown in FIG. 2, the inner chamber 18 comprises a cooling circuit 32 configured to receive the flow of coolant fluid between an inlet 34 laterally disposed at one end of the rear wall 28 adjacent to one side wall 24 and an outlet 36 laterally disposed at the other end of the rear wall 28.

The cooling circuit 32 is formed by a series of three partition walls extending inside the inner chamber 18 between the top and the bottom wall 20, 22. The first and third partitions walls are separate metallic partition plates 40, 43, fitted into the inner chamber 18 of the body 12 through a form-fit connection. The second partition wall 42 is here built integral with the body 12 of the cooling box 10, preferably at the same time as the exterior walls.

Figure 3:
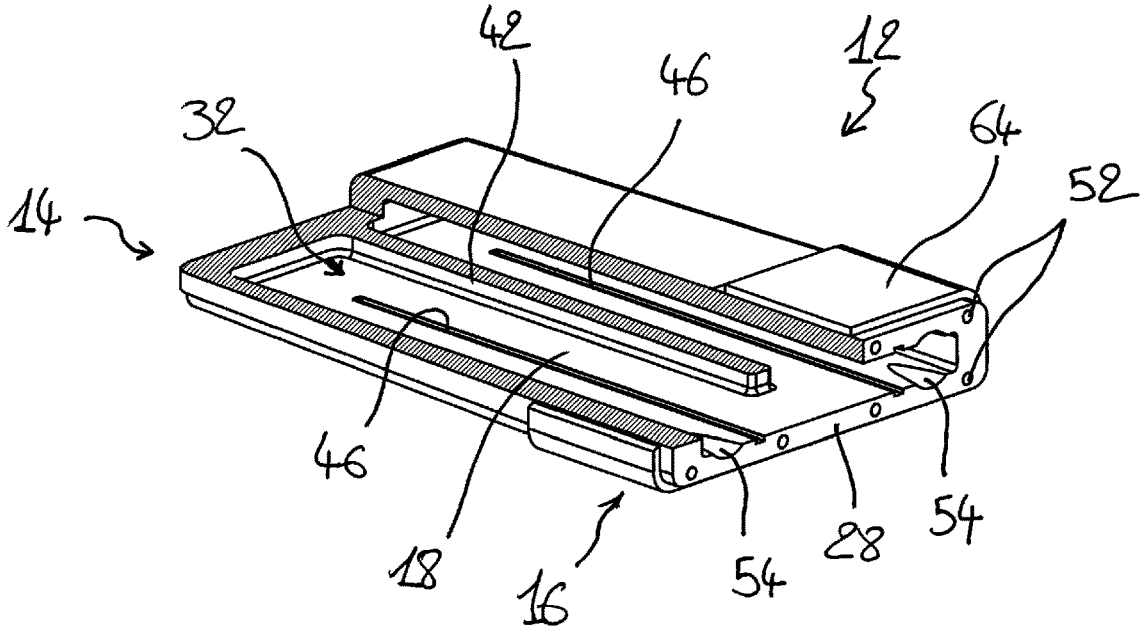
FIG. 3 is a perspective view of hollow body of the cooling box of FIG. 1, with a partial cut portion through plane 2 of FIG. 1.

The partition plates 40, 43 comprise respectively two tongues 44, shown in FIGS. 2 and 3, the dimensions of which correspond to the dimensions of slots 46 formed in the top and bottom walls 20, 22 respectively. The tongues 44 engage in the slots 46 in a form-fit connection, thereby securing the partition plates.

As described in detail below, the series of partition walls are arranged to create a meander that will guide the coolant fluid from the inlet 34, through all the volume of the inner chamber 18 before reaching the outlet 36. The embodiments described here show preferred examples of cooling circuit but the skilled person will understand that other cooling paths can be possibly achieved within the scope of the disclosure.

As shown in FIG. 2, the three partition walls are straight and have substantially the same length. The walls are disposed parallel with each other and orthogonal to the rear wall 28 of the cooling box 10. The length of the partition walls is smaller than the longitudinal length of the inner chamber to leave a passage for the coolant fluid. Within the inner chamber, the partition walls are successively placed in a staggered arrangement between the inlet 34 and the outlet 36, thereby defining three U-shaped loops. The partition walls are also preferably orthogonal to the top and bottom walls 20, 22 of the cooling box 10.

Describing in the lateral direction of the cooling box successively from the inlet to the outlet, a first partition wall, formed by the first partition plate 40, is positioned right after the inlet 34 and extends from the rear wall 28, then a second partition wall 42 extends from the front wall 26, and a third partition wall, formed by the third partition plate 43, is positioned right before the outlet and extends from the rear wall 28.

In the assembled cooling box 10, the opening 30 of the rear end 16 is sealed by a gasket 48, pressed against the rear wall 28 by a metallic cover plate 50.

The manufacturing process of the cooling box 10 starts with providing the hollow body 12. The body 12 may be obtained from a blank of solid metal having the overall parallelepiped shape of the cooling box, or it may be a cast hollow element with the inner chamber pre-formed therein. In the latter situation, the second partition wall 42 may be already formed in the body. In the situation where the body comes from a full element, it has to be machined in order to define the inner chamber 18. The body 12 is emptied, and the second partition wall 42 is created by leaving the necessary amount of material. Preferably, the hollow body comprises the rear wall 28 and threaded holes 52 drilled for later fixation of the cover plate 50. The skilled person will understand that machining the body may imply any suitable step involving machine tools.

The top and bottom walls 20, 22 are then further machined to create the slots 46 for receiving partition plates 40, 43. Additionally, during this step, conical digs 54 are also machined at the location of the inlet 34 and the outlet 36 of the inner chamber 18 to facilitate the entry respectively the exit of the fluid flow in/from the cooling circuit 32.

In another step, the partition plates 40, 43 are inserted in the slots 46 of the inner chamber 18 to form the first and third partition walls. These partition plates 40, 43 are made in a separate manufacturing process and provided with tongues 44, corresponding to the slots 46 of the inner chamber 18, in order to achieve a form-fit connection. The partition plates 40, 43 are slid in the slots 46 until coming into abutment with the end of the slots. The skilled person will understand that the tongues and the slots may be dimensioned to provide sufficient sealing of the form-fit connection.

Once the partition plates 40, 43 are inserted into the slots of the inner chamber, the opening 30 of the rear wall 28 of the body is sealingly closed by the metallic cover plate 50, through the gasket 48. The cover plate 50 is connected to the rear wall 28, e.g. by screws 56 as shown in FIG. 1. The screws 56 are introduced into bores 58 matching the threaded holes 52 in the rear wall 28. In order to ensure the sealing of the connection, the gasket 48 is previously added between the rear wall 28 and the cover plate 50.

The cover plate 50 has one inlet port 60, provided to communicate with the inlet 34 of the inner chamber 18, and one outlet port 62, provided to communicate with the outlet 36 of the inner chamber 18. The gasket 48 is also designed with corresponding openings in front of the inlet 34 and outlet 36.

In the assembled cooling box 10, the gasket 48 is dimensioned to extend between the partition plates 40, 43 and the cover plate 50 in order to ensure a sealed connection between the partition plates 40, 43 and the cover plate 50. The cover plate 50 further applies a pressure load on the edges of the partition plates 40, 43 via the gasket 48, securing the partition plates in the inner chamber 18.

The rear end of the body 12 is surrounded by a wide metallic collar 64 provided to form the connection between the cooling box 10 and the wall of the furnace, for example to weld the cooling box 10 to a furnace shell. This connection is not discussed here but may comprise any suitable means, such as for example a soldered joint.

Another preferred embodiment of the cooling box will now be described with reference with FIGS. 4 to 6. This embodiment mainly differs from the previous embodiment in the shape of the cooling circuit inside the cooling box. It will be described in comparison with the previous embodiment. Features not detailed below should be deemed similar to the previous embodiment, and features having the same technical function will keep the same numeral reference increased by 100.

Figure 4:
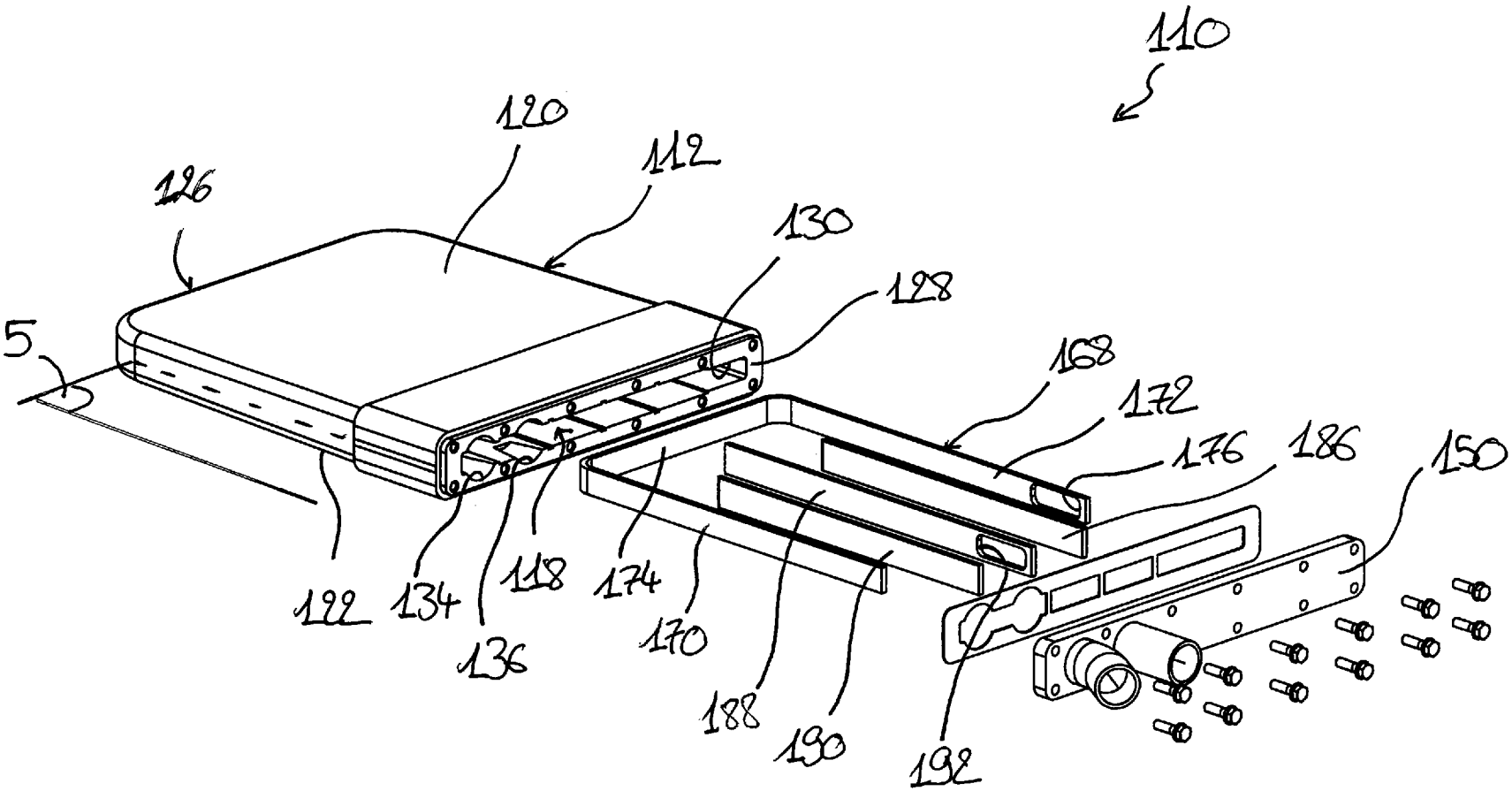
FIG. 4 is an exploded perspective view of another preferred embodiment of the cooling box according to the disclosure.

The cooling box 110 as shown in FIG. 4 comprises a hollow body 112 with an inner chamber 118 defined by a top wall 120, a bottom wall 122, and peripheral walls comprising a rear wall 128 with a wide opening 130.

The inner chamber 118 comprises a cooling circuit 132 configured to receive a flow of a coolant fluid between an inlet 134 and an outlet 136. In this embodiment, the inlet 134 and the outlet 136 of the inner chamber 118 are arranged next to one another on one end of the rear wall 128.

The cooling circuit 132 comprises five partition walls formed by five metallic partition plates extending inside the inner chamber 118 between the top and the bottom walls 120, 122.

Manufacturing of the cooling box 110 according to this second embodiment comprises the same steps as for the previous embodiment, with slightly different operations as described below.

A first partition plate 170 and a fifth partition plate 172 are formed by the legs of a U-shaped element 168 dimensioned to extend inwardly parallel to the peripheral walls of the body 112 to create a path of constant width adjacent to the peripheral walls. The U-shaped partition plate 168 comprises a connecting web 174 perpendicular to its legs and joining the ends of the first and fifth partition plates 170, 172. The first partition plate 170 is disposed between the inlet 134 and the outlet 136. A free end of the fifth partition plate 172 comprises a first aperture 176 near the opening 130 in order to allow coolant fluid to pass through the fifth partition plate 172. The connecting web 174 of the U-shaped element 168 forms a channel near a front wall 126 of the body 112, this channel being parallel to the front wall 126.

The form-fit connection between the U-shaped element 168 and the body 112 is obtained by stepped surfaces in the top and bottom walls 120, 122. The stepped surfaces 178 comprise a proximal face 180 closer to a plane passing through the centre plane of the inner chamber 118 parallel to the top and bottom walls 120, 122, and a distal face 182 further away from the centre plane of the inner chamber 118. The proximal face 180 is flat and has a constant width along the peripheral walls of the body 112. The distal face 182 is another flat surface having the same dimensions as the U-shaped element 168 and disposed in the inner chamber 118 inwardly with regard to the proximal face 180. A positioning step 184 is created between the proximal and distal faces 180, 182, forming an abutment for the U-shaped element 168.

Preferably, the positioning steps 184 of the top and bottom walls are identical, having a height of a few millimetres, like for example between 3 and 5 mm. The U-shaped element 168 can hence be entirely received against the two positioning steps 184.

The step of introducing the U-shaped element 168 involves sliding the U-shaped element 168 over the distal faces of the top and bottom walls 120, 122. The first and fifth partition plates 170, 172 of the U-shaped element 168 slide against the sides of the positioning step 184 until the connecting web 174 abuts against the positioning step 184 near the front wall 126 in a form-fit connection.

Figure 5:
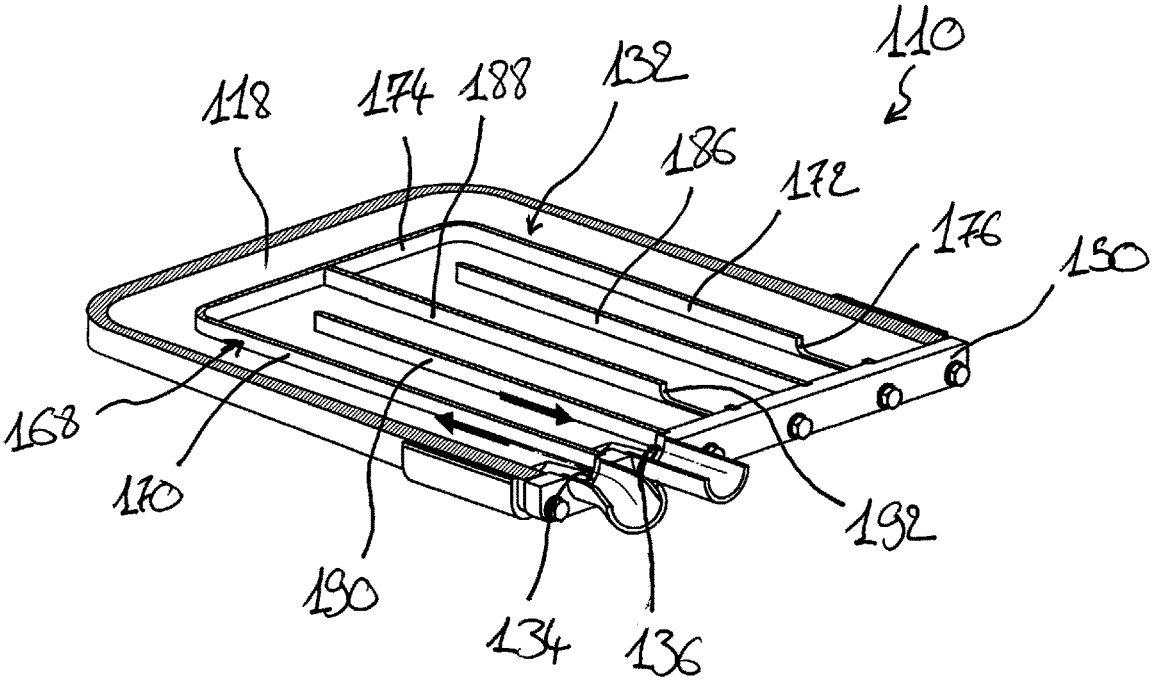
FIG. 5 is a perspective view of the cooling box of FIG. 4 cut through a plane 5 of FIG. 4.
Figure 6:
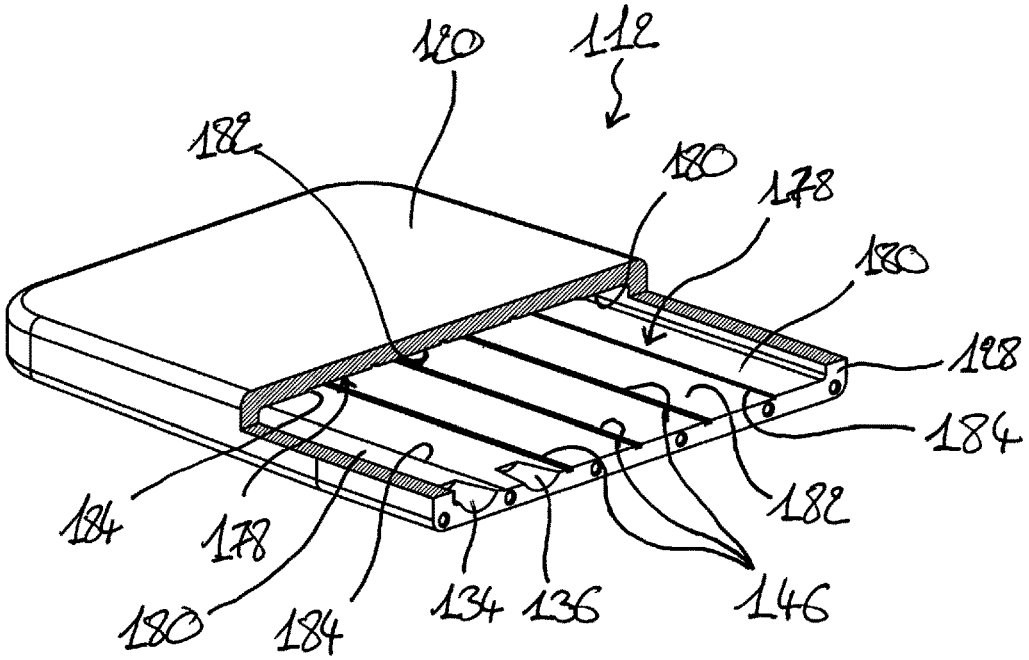
FIG. 6 is a perspective view of hollow body of the cooling box of FIG. 4, with a partial cut portion through plane 5 of FIG. 4.

As shown in FIGS. 5 and 6, a second, third and fourth partition plate 190, 188, 186 extend from the rear wall 128 between the first and fifth partition plates 170, 172. These second, third and fourth plates are parallel to the first and fifth partition plates 170, 172 and successively disposed in the lateral direction of the cooling box 110.

The second, third and fourth partition plates 190, 188, 186 are engaged in a form-fit connection inside the inner chamber 118 in straight slots 146 formed in the distal faces 182 of the top and bottom walls 120, 122, extending from the opening 130 of the rear wall 128. As an alternative to the first embodiment, the second, third and fourth partition plates 190, 188, 186 are here not provided with corresponding tongues but engage with their edges directly into the slots 146. Insertion of the second, third and fourth partition plates 190, 188, 186 in the slots is similar to the previous embodiment provided that the second, third and fourth partition plates 190, 188, 186 are inserted after the U-shaped element plate 168.

Closest to the fifth partition plate 172, the fourth partition plate 186 has a length smaller than the length of the second leg of the U-shaped element 168 leaving a passage for the flow of cooling fluid. Then, the third partition plate 188 is dimensioned to come into sealing contact with both the connecting web 174 of the U-shaped element 168 and the cover plate 150. The third partition plate 188 comprises a second aperture 192 near the connecting web 174 in order to allow the coolant fluid to flow through when it comes close to the rear wall. The second partition plate 190 is similar to the fourth partition plate 186 and generates a last loop in the cooling circuit 132 between the third partition plate 188 and the outlet 136.

The coolant fluid flow, symbolized by arrows in FIG. 5, enters through the inlet, flows along the first partition plate 168, the connecting web 174 and the fifth partition plate 172. The coolant fluid then flows through the first aperture 176 to the other side of the fifth partition plate 172. From there, the coolant fluid flows up and down along the fourth, third and second partition plate 186, 188, 190 to finally reach the outlet 136.

The invention claimed is:

1. A cooling box for a metallurgical furnace comprising:

an elongated hollow body extending from a front end, to an opposite rear end, said rear end being, in use, connected to a wall of the furnace;

the body having external walls comprising a top wall, an opposite bottom wall, and peripheral walls connecting edges of the top and bottom walls of the body;

the body further comprising an inner chamber having a cooling circuit configured to receive a flow of coolant fluid therein between at least one inlet and at least one outlet;

said cooling box further comprising at least one partition plate fitted in the inner chamber through a form-fit connection to form said cooling circuit, wherein the at least one partition plate extends from the top wall to the bottom wall;

the top and bottom walls respectively comprising at least one elongated slot facing one another to receive the at least one partition plate.

2. The cooling box according to claim 1, wherein the rear end of the cooling box comprises a rear wall with an opening sealed by a metallic cover plate.

3. The cooling box according to claim 2, wherein the cover plate has at least one inlet port and at least one outlet port, respectively in communication with the inlet and outlet of the inner chamber.

4. The cooling box according to claim 3, wherein the at least one partition plate is secured inside the inner chamber by the cover plate.

5. The cooling box according to claim 1, wherein the at least one partition plate comprises tongues corresponding to the elongated slots of the top and bottom walls, in order to engage the partition plate with the top and bottom walls.

6. The cooling box according to claim 1, wherein the at least one partition plate comprises an aperture to let the coolant fluid through the partition plate.

7. The cooling box according to claim 1, wherein the at least one partition plate comprises a U-shaped element.

8. The cooling box according to claim 7, wherein the top and bottom walls have a stepped surface with a distal face and a proximal face forming an abutment step for the at least one partition plate.

9. The cooling box according to claim 2, wherein the cooling box further comprises a gasket between the rear wall and the cover plate.

* * * * *